United States Patent [19]

Page, Jr.

[11] 4,002,233

[45] Jan. 11, 1977

[54] KNOCK-DOWN DISPLAY CASE KIT

[75] Inventor: Vernon Page, Jr., Montclair, N.J.

[73] Assignee: Lawrence Peska Associates, Inc., New York, N.Y. ; a part interest

[22] Filed: Feb. 20, 1976

[21] Appl. No.: 659,667

[52] U.S. Cl. ..... 206/45.34; 190/44; 190/53; 206/450; 220/4 F; 206/577

[51] Int. Cl.[2] ..... B65O 25/54; A45C 13/00

[58] Field of Search ..... 220/4 F, 82 A; 190/53, 190/58 A, 41 R, 21, 44; 206/45.34, 450; 217/12 R, 13, 43 R, 45

[56] References Cited

UNITED STATES PATENTS

| | | | |
|---|---|---|---|
| 1,186,642 | 6/1916 | Alamy | 206/45.34 X |
| 1,664,431 | 4/1928 | Ringer | 190/41 R |
| 2,278,359 | 3/1942 | Nagle | 206/45.34 |
| 2,388,297 | 11/1945 | Slaughter | 190/53 X |
| 2,739,727 | 3/1956 | Fudge | 220/4 F |
| 2,759,655 | 8/1956 | Levy | 206/45.34 |
| 2,862,640 | 12/1958 | Somavia | 220/4 F |
| 2,986,226 | 6/1961 | Swartz | 206/45.34 X |
| 3,128,002 | 4/1964 | Buchanan | 220/4 F |
| 3,710,901 | 1/1973 | Guard et al. | 190/58 A |
| 3,807,537 | 4/1974 | O'Reilly | 190/53 |
| 3,935,931 | 2/1976 | Kaplan | 220/4 F X |

FOREIGN PATENTS OR APPLICATIONS

| | | | |
|---|---|---|---|
| 474,683 | 3/1915 | France | 190/21 |
| 951,991 | 3/1964 | United Kingdom | 220/4 F |
| 1,015,496 | 1/1966 | United Kingdom | 220/4 F |

*Primary Examiner*—William Price
*Assistant Examiner*—Stephen Marcus

[57] ABSTRACT

A knock-down case kit for different size contents including size panels having dovetail grooves slidably receiving complemental slides on the bottom edges of mirror-image top, bottom, front and back panels. The two bottom panels are hingedly connected to each other and a handle and complementary latch element are detachably coupled to the top panels. In order to vary the depth of the assembled case, alternate size top, bottom, front and back panels are provided in the kit which may be substituted for like panels. Each panel is made from transparent plastic so the contents may be displayed without opening the assembled case.

7 Claims, 5 Drawing Figures

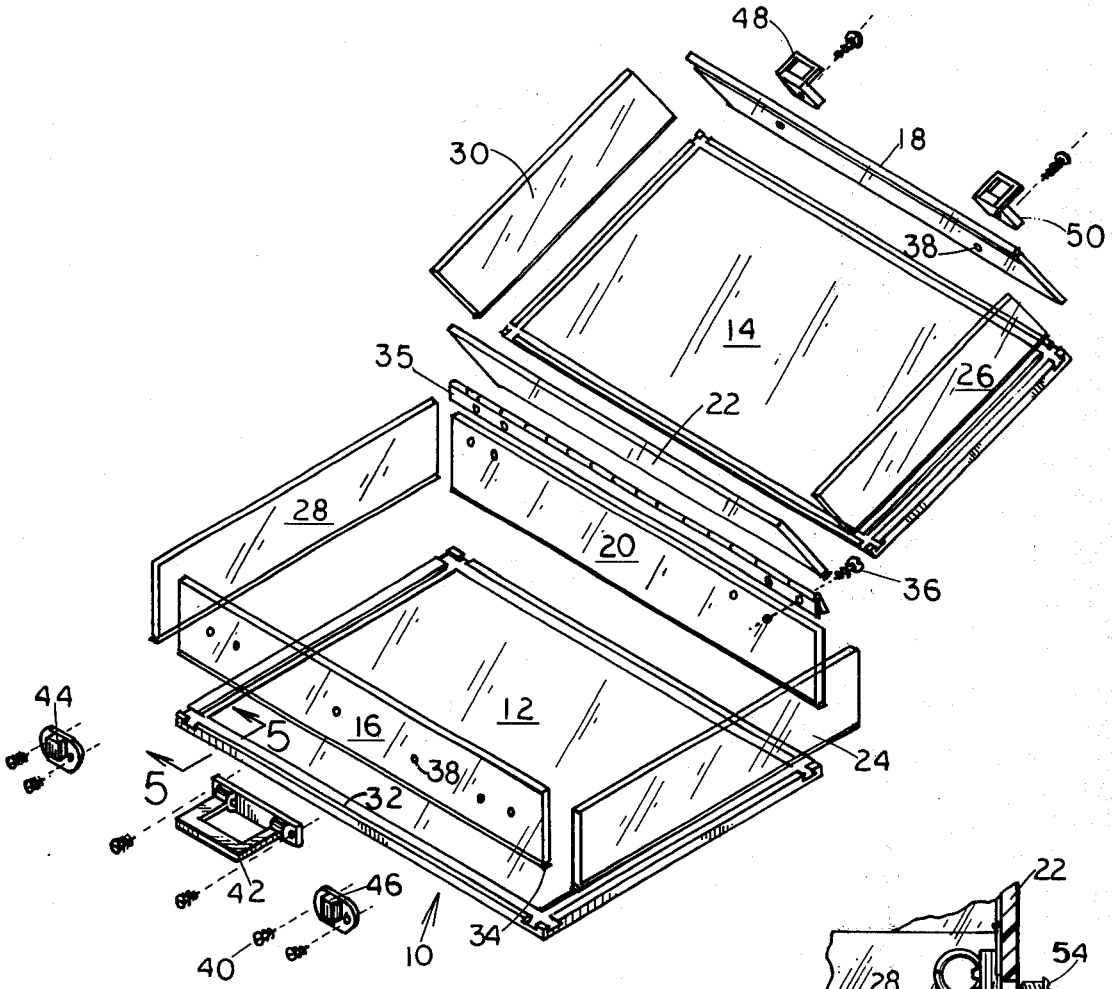
FIG. 1
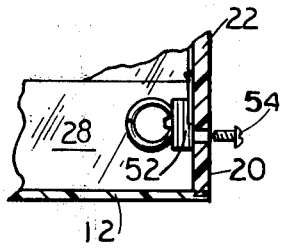
FIG 2
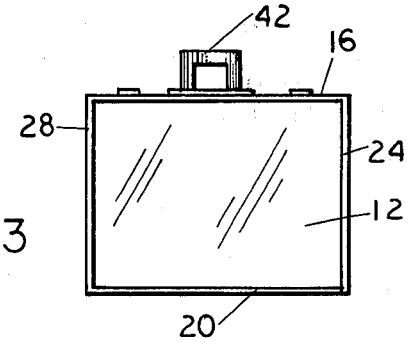
FIG 3
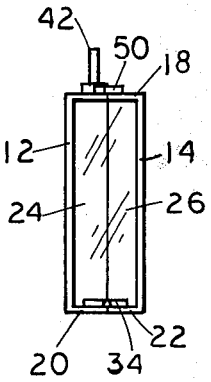
FIG 4
FIG 5
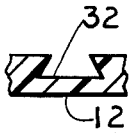

KNOCK-DOWN DISPLAY CASE KIT

BACKGROUND OF THE INVENTION

This invention relates to a portfolio case, and more particularly, a knock-down portfolio case whose dimensions may be varied to complement the size of the contents placed in the case.

Many salesman carry samples of their products of illustrative brochures in a travelling portfolio case to display when with prospective customers. One salesman may carry a variety of products of different bulk. This invention is designed to enable that salesman to conveniently display those products in a travelling portfolio case, regardless of their size or bulk.

SUMMARY OF THE INVENTION

Accordingly, it is an object of this invention to provide a portfolio case which may be constructed from transparent, durable plastic material to display the contents placed in the interior thereof without removal of the contents.

A further object of this invention is to provide a portfolio case of the character indicated which has a knock-down construction, enabling the case to be disassembled quickly and reassembled with parts having increased dimensions to enable the user to carry articles of a variety of sizes.

The portfolio case of the present invention consists of:

- a pair of identical rectangular side panels;
- a pair of identical rectangular top panels;
- a pair of identical rectangular bottom panels;
- a pair of identical rectangular front and back panels;
- means on the top, bottom, front and back panels for slidably connecting one of the panels to each of the side panels;
- removable hinge means pivotally connecting the bottom panels to each other; and
- alternate top, bottom, front and back panels of a different depth interchangeable with the top, bottom, front and back panels.

BRIEF DESCRIPTION OF THE DRAWING

Further objects and advantages of the invention will become more apparent from the following description and claims, and from the accompanying drawing, wherein:

FIG. 1 is an exploded perspective view of the portfolio case of the present invention;

FIG. 2 is an enlarged detailed view of a portion of the case illustrated in FIG. 1, and illustrating an optional accessory mounted in the case;

FIG. 3 is a front view in elevation of the case shown in FIG. 1 positioned in a upright condition;

FIG. 4 is a side view in elevation of the case shown in FIG. 3; and

FIG. 5 is a cross-sectional view taken substantially along the plane indicated by line 5—5 of FIG. 1.

DETAILED DESCRIPTION OF THE PREFERRED EMBODIMENT

Referring now to the drawing in detail, wherein like numerals indicate like elements throughout the several views, the portfolio case 10 of the present invention is illustrated in FIG. 1.

Case 10 is preferably constructed from substantially rectangular, individual transparent plastic panels such as "Plexiglas". Included in the construction are a pair of identical side panels 12, 14, a pair of identical top panels 16, 18, a pair of identical bottom panels 20, 22, and four identical front panels have the same dimensions and are interchangeable.

Case 10 is of knock-down design wherein each of the identical side panels 12, 14 include dovetail grooves 32 to receive mating complementally-shaped slides 34 extending from the bottom edge of each of the panels 16, 20, 24 and 28 (slidable into grooves 32 in side panel 14). A hinge plate 35 is attachable by screws 36 to panels 20, 22 and pivotally connects these panels and the assembled halves of portfolio case 10.

Panels 16 and 20 have edges which overlap front and back panels 24 and 28 when the panels are slid in place from the edges of side panel 12 so that when assembled the front and back panels will be held in place by the overlapping edges of panels 16 and 20. The same is true with regard to the other half of case 10.

In order to complete the knock-down construction of case 10 holes 38 are provided in top panels 16, 18 to receive screws 40 for attaching a handle 42 and latch elements 44, 46 to top panel 16 and complemental pivotal latch elements 48, 50 to top panel 18, which are received over latch elements 44, 46 respectively when case 10 is closed.

In order to vary the dimensions and depth of case 10, the case 10 may be quickly disassembled by sliding panels 16, 18, 20, 22, 24, 26, 28 and 30 out of the grooves 32 in panels 12, 14 and replacing them with panels of more or less depth in accordance with the desires of the user. Alternate size panels may be supplied with the knock-down kit for constructing case 10.

A further optional accessory is a ring binder 52 (FIG. 2) for looseleaf panels which may be attached by screws 54 to bottom panel 20.

I claim:

1. A knock-down portfolio case kit comprising:
- a pair of identical rectangular side panels;
- a pair of identical rectangular top panels;
- a pair of identical rectangular bottom panels;
- a pair of identical rectangular front and back panels;
- means on said top, bottom, front and back panels for slidably connecting one of said panels to each of said side panels;
- removable hinge means pivotally connecting said bottom panels to each other; and
- alternate top, bottom, front and back panels of a different depth interchangeable with said top, bottom, front and back panels.

2. A knock-down portfolio case kit in accordance with claim 1, wherein all of said panels are rigid, transparent plastic.

3. A knock-down portfolio case kit in accordance with claim 1, wherein said slidable connection means includes a slide on an edge of each of said top, bottom, front and back panels received within a dovetail groove spaced from each of the edges of one of said side panels.

4. A knock-down portfolio case kit in accordance with claim 3, wherein each of said slides is complemental in shape to said dovetail grooves.

5. A knock-down portfolio case kit in accordance with claim 1, including a handle detachably connected to one of said top panels.

6. A knock-down portfolio case kit in accordance with claim 1, includes mating latch elements detachably connected to each of said top panels.

7. A knock-down portfolio case kit in accordance with claim 1, including a looseleaf ring binder detachably connected to one of said bottom panels.

* * * * *